US007458321B2

(12) United States Patent
Bornstein et al.

(10) Patent No.: US 7,458,321 B2
(45) Date of Patent: Dec. 2, 2008

(54) NON-LETHAL LAND MINES

(75) Inventors: Aharon Bornstein, Rishon Lezion (IL); Uri Bach, Efrat (IL); Noam Shafir, Ramat Gan (IL)

(73) Assignee: Israel Atomic Energy Commission, Yavne (IL)

( * ) Notice: Subject to any disclaimer, the term of this patent is extended or adjusted under 35 U.S.C. 154(b) by 0 days.

(21) Appl. No.: 10/570,968

(22) PCT Filed: Sep. 6, 2004

(86) PCT No.: PCT/IL2004/000801

§ 371 (c)(1),
(2), (4) Date: May 15, 2006

(87) PCT Pub. No.: WO2005/024338

PCT Pub. Date: Mar. 17, 2005

(65) Prior Publication Data

US 2007/0022896 A1 Feb. 1, 2007

(30) Foreign Application Priority Data

Sep. 11, 2003 (IL) ..... 157871

(51) Int. Cl.
*F42B 23/00* (2006.01)

(52) U.S. Cl. ..... 102/401; 102/428

(58) Field of Classification Search ..... 102/401, 102/428, 429

See application file for complete search history.

(56) References Cited

U.S. PATENT DOCUMENTS 3,780,655 A * 12/1973 Allen et al. ..... 102/335
5,193,907 A * 3/1993 Faccioli et al. ..... 366/130

* cited by examiner

*Primary Examiner*—Michael J. Carone
*Assistant Examiner*—Gabriel J Klein
(74) *Attorney, Agent, or Firm*—Bachman & LaPointe, P.C.

(57) ABSTRACT

A non-lethal anti-personnel land mine comprising a sealed container having a first chemical reactant contained therein, and a second container having a second chemical reactant contained therein, the container being positioned within the mine to assure that a stepping action on the mine will result in the opening of the container and the release of the contents thereof into contact with the second chemical reactant, whereby the contact results in a fast chemical reaction non-lethal to the person stepping on the mine.

7 Claims, 2 Drawing Sheets

NON-LETHAL LAND MINES

The present invention relates to the protection of areas against intrusion. More particularly, the invention provides a non-lethal land mine, which frightens and/or sprays a dye on intruders stepping thereon. The mine can be configured to generate a blinding bright light or a plume of smoke, or a non-lethal explosion, any of which warns the intruder that his/her entry has been detected.

The term intruder as used herein while mainly intended to denote a human intruder is also intended to refer to an animal intruder wherein such non-lethal land mines are intended to discourage animals from entering a certain protected area.

In the previous century lethal land mines were used in large numbers to serve protective purposes, allowing a small defense force to keep a larger attacking force away from an area being defended. World wide there have been dozens of wars, many of them civil wars, resulting in millions of active lethal mines left in the ground, and these have caused untold suffering to civilians, and particularly to children who have typically lost a leg and/or sustained further injuries, all this often long after the cessation of hostilities. Collecting and disabling buried mines is a dangerous and difficult task, and requires resources typically unavailable in the third world countries most afflicted thereby. After a word-wide outcry, an international treaty was agreed to by many countries, with the notable exception of the USA, banning the deployment of lethal and limb-wounding anti-personnel mines.

The treaty has naturally led military planners to seek some alternative means of defense, and thus there has developed a strong need for the non-lethal land mine (NLLM). The NLLM may be intended to disable the intruder long enough to enable his/her capture, or to frighten the intruder sufficiently to abandon the attempted infiltration. The NLLM can also be used to mark the intruder for possible arrest later. A major advantage of the NLLM is that if accidentally triggered by friendly forces, little permanent harm results. There are many situations where a military unit has difficulty in distinguishing between friend and foe, and the conventional mine causing irreparable injury or death is unsuitable for deployment in such circumstances.

An electrical type of NLLM is disclosed in US Patent no. 5,636,183 by McNulty, Sr. High voltage at low power is delivered by darts shot in the direction of the expected enemy forces, each dart remaining attached to its own power line after hitting an intruder and temporarily incapacitating the person hit. The device requires outside sensors which provide the firing signal. The mine has multiple firing bays, each provided with it's own high voltage transformer and circuit board. Means for preventing short circuits are also provided. Further features include radio control and a transceiver, an electric storage battery, and a low battery sensor. The device has the advantage that it can be electrically deactivated, but the cost of the device is clearly far beyond the cost of alternative means of defending a defined area against intrusion. Also, the technical infrastructure needed to operate the device is too complex for operation by unskilled persons.

It is therefore one of the objects of the present invention to obviate the disadvantages of prior art NLLMs and to provide a chemical device which operates independently and requires no battery and no additional intrusion detection sensors.

It is a further object of the present invention to provide a NLLM, which can be manufactured at a moderate and competitive cost.

The present invention achieves the above objects by providing a non-lethal anti-personnel land mine comprising a sealed container having a first chemical reactant contained therein, and a second container having a second chemical reactant contained therein, said container being positioned within said mine to assure that a stepping action on said mine will result in the opening of said container and the release of the contents thereof into contact with said second chemical reactant, whereby said contact results in a fast chemical reaction non-lethal to the person stepping on said mine.

In preferred embodiments of the present invention there is provided a non-lethal anti-personnel land mine comprising a sealed fragile container having a first chemical reactant contained therein, and a second container having a second chemical reactant contained therein, said fragile container being provided with support means in contact therewith and positioned to assure that a stepping action on said mine will result in the breaking of said fragile container and the release of the contents thereof into contact with said second chemical reactant, whereby said contact results in a fast chemical reaction non-lethal to the person stepping on said mine.

In especially preferred embodiments of the present invention there is provided a non-lethal anti-personnel land mine wherein said chemical reaction is a pyrotechnical reaction, such as that which can release smoke, color light, noise or a combination thereof.

In other preferred embodiments of the present invention said chemical reaction results in the release of an irritant material and in yet other preferred embodiments said chemical reaction results in the release and dispersion of a color dye material such as a phosphorescent dye.

In a most preferred embodiment of the present invention there is provided a non-lethal anti-personnel land mine wherein said first container is a thin hermetically-sealed glass vial and said support means is a washer-like element having a central opening for receiving a segment of said vial, said washer-like element having a diameter substantially greater than that of said glass vial for elevating said glass vial above a ground support surface as well as being positioned to transfer body weight forces directly to said vial large enough to break the same.

Alternatively, said first container is made of a pierceable material and said land mine includes mechanical means for bringing a sharp object into contact with said material for piercing the same and releasing the contents thereof as a result of a stepping action on said mine such as by activation of a spring mechanism.

Yet further embodiments of the invention will be described hereinafter.

It will thus be realized that the novel device of the present invention serves to reduce the need for patrolling forces and will put intruders to flight. The mine can be mass-produced at moderate cost and can be deployed even in areas where there is some possibility of entry of friendly persons. The mine can be camouflaged to avoid detection. An embodiment of the mine including fins is provided for use on sand or very soft earth. There is no limit to the size of the perimeter, which can be defended.

While the present text refers to a fragile glass vial as suitable for containing one of the reactants, it is not essential or intended that the whole length of the vial be fragile. As it is desirable that the vial should break near its midpoint, a weakening notch can be positioned there and the remainder of the vial can be made of thicker material, and thereby ensure controlled breakage at the desired location.

Deployment can be effected by unskilled labor, using reasonable care not to break the fragile vial. No infrastructure is needed during or after deployment.

When no longer required the mines can be collected, or deliberately activated from a safe distance, again using care appropriate to the chosen deactivation method.

The effect of the chemical reaction taking place on mine activation can be tailored to suit the expected circumstances of use. For example, if the major foreseen threat is infiltration at night, the NLLM producing a blinding light could be chosen. If the primary objective is the arrest of the intruder, the die-spraying embodiment will greatly ease the task of detection. For determining a distant intrusion location during daytime, the smoke plume would be the preferred option. The effect generated by the mine is of course a function of the type of chemical reactants used.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

IN THE DRAWINGS

Figure 1:
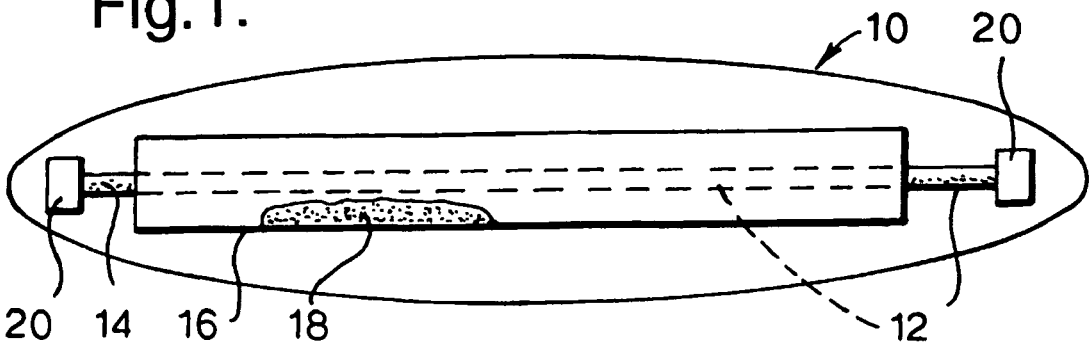
FIG. 1 is a diagrammatic view of a preferred embodiment of the NLLM according to the invention.

There is seen in FIG. 1 a non-lethal anti-personnel land mine 10 comprising a sealed fragile container 12 having a first chemical reactant 14 contained therein. The container 12 is preferably made of thin glass.

A second container 16 holds a second chemical reactant 18.

The fragile container 12 is provided with support means 20 in contact with the ground either directly or indirectly. Support means 20 are so positioned to assure that a stepping action on the mine 10 will result in the breaking of the fragile container 12. The reactant 14 released from the fragile container 12 is directed to immediately make contact with the second chemical reactant 18. Contact results in a fast chemical reaction, which is non-lethal but frightening to the person stepping on the mine 10.

In the present embodiment the two reactants 14, 18 when combined result in the release of an irritant gas, for example tear gas.

With regard to the rest of the figures, similar reference numerals have been used to identify similar parts.

Figure 2:
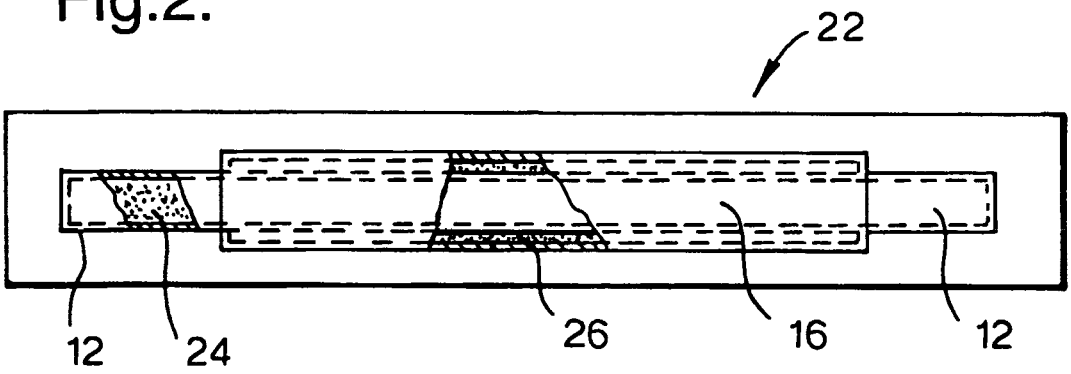
FIG. 2 is a diagrammatic view of an embodiment intended to produce an exothermic chemical reaction.

Referring now to FIG. 2, there is referred to a second embodiment of a non-lethal anti-personnel land mine 22. The reactants 24, 26 chosen in the present embodiment are intended to produce an exothermic chemical reaction. Table 1 lists suitable examples.

TABLE 1

| Desired effect | Reactant to combine with | Reactant |
|---|---|---|
| Heat generation | $KClO_3$ | sugar |
| Heat generation | $KClO_3$ | Sulfur |
| High temp., no gas | Al | $Fe_3O_4$ |
| Very high temperature | Thermite | $Ba(NO_3)_2$ |

Figure 3:
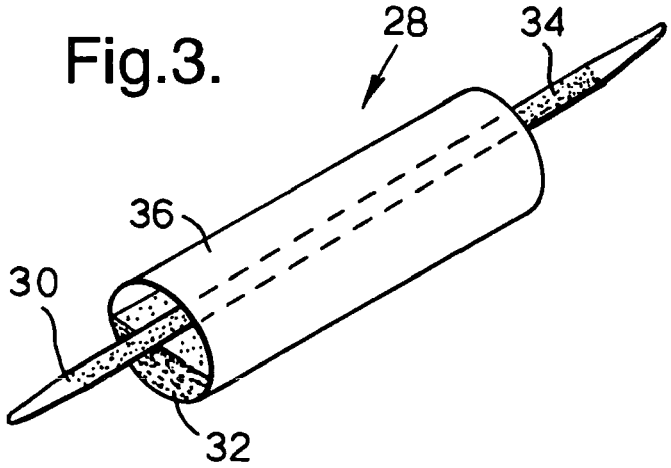
FIG. 3 is a diagrammatic view of an embodiment configured to produce a strong light flash.

FIG. 3 shows a NLLM 28 wherein the reactants 30, 32 are suitable for producing a strong light flash, which is of course particularly effective at night. The mine 28 when stepped on starts a chemical pyrotechnical reaction, resulting in the loud noise similar to that heard from an ignited rocket motor.

The mine 28 comprises a thin glass tube 34 closed at both ends and containing a first reactant 30, for example an oxidizer that is liquid at room temperature, such as nitric acid.

A flexible outer container 36 holds the second reactant 32, which is the remaining component of a hypergolic bipropellant rocket fuel, preferably in granular form. The tube is made of plastic, or of carton, assembled and filled, and glue sealed.

The mine operates when the outer container 36 being stepped upon applies a bending force to break the thin glass tube 34, spilling the liquid oxidizer onto the fuel.

Very high burn rates for creating an unconfined explosion can be generated by the combination $Pb_3O_4$+Ti. The titanium is preferably in fine granular or powder form.

Safety during actuation, as well as economy of manufacture of the mine is ensured by use of small measured quantities of at least one of the reactants 30, 32.

Figure 4:
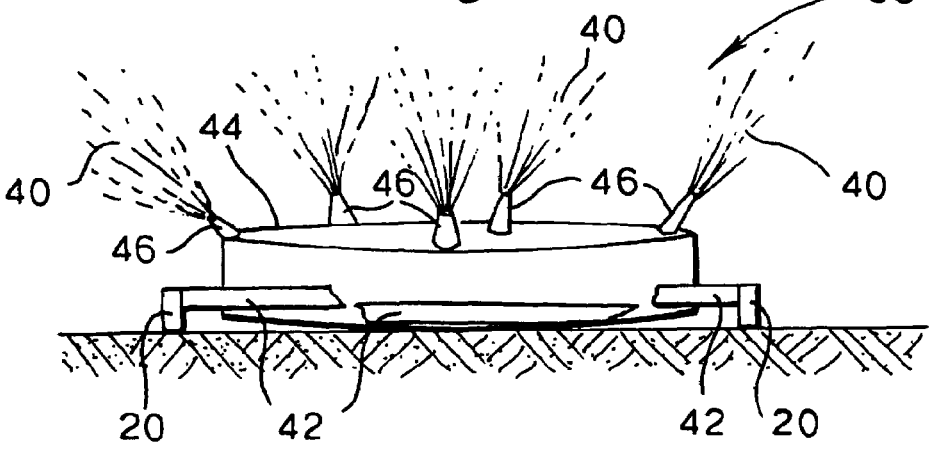
FIG. 4 is a diagrammatic view of a dye-spraying NLLM.

Turning now to FIG. 4, there is seen a non-lethal anti-personnel land mine 38 which has been stepped upon and wherein the chemical reaction resulted in the release and dispersion by pressure of a liquid color dye material 40.

The chemical reaction initiated when the thin glass container 42 was broken caused pressure build up inside the housing 44. The pressure caused jets of liquid color dye material to emerge through a plurality of nozzles 46 arranged in a ring and pointing in all directions. The die material 40 remains on the intruder for at least a day, enabling security forces to apprehend the person triggering the NLLM 38.

Figure 5:
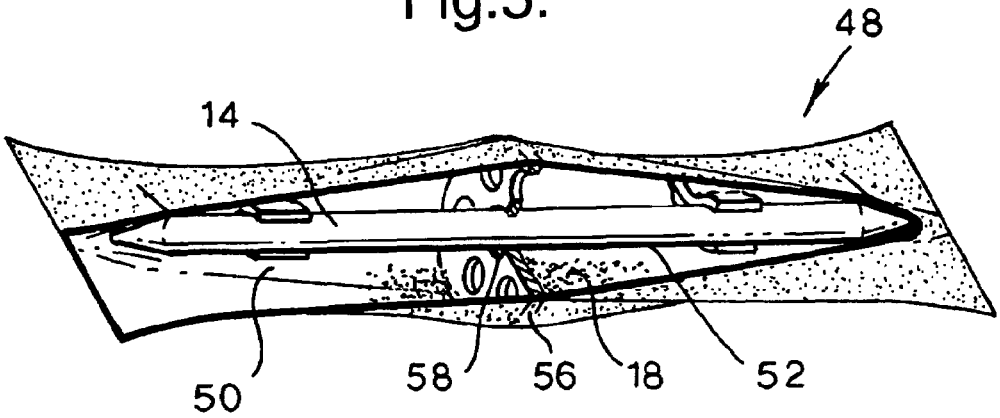
FIG. 5 is a perspective, partially cut-away view of an embodiment provided with a central washer intended to break the first container.

Referring now to FIG. 5, there is depicted a NLLM 48 wherein the second container 50 is in the form of an envelope surrounding the first container 52 and its support means 54. When triggered the NLLM 48 emits a strong light, according to Table. 2

TABLE 2

| Desired effect | Reactant (preferably liquid) | Reactant (preferably granular) |
|---|---|---|
| Strong white light, 3000° C. | $NaNO_3$ | Mg |
| Strong white light | $KclO_3$ | Mg |
| Fast burn | $KclO_4$ | Mg + $Ba(NO_3)_2$ |
| Red light | $Sr(NO_3)_2$ + PVC | Mg |
| Green light | $Ba(NO_3)_2$ + PVC | Mg |
| Yellow light | $KclO_4$ + $Na_2(C_2O_4)$ | Mg |
| Blue light | $NH_4ClO_4$ | $CuSO_4$ + wood powder |

The first container 52 is a thin hermetically-sealed glass vial. The support means is a washer-like element 56 having a central opening 58 for receiving a segment of the glass vial 52, the washer-like element 56 having a diameter substantially greater than that of the vial 52 for elevating the vial 52 above a ground support surface as well as being positioned to transfer body weight forces directly to the vial 52 large enough to break the same.

Figure 6:
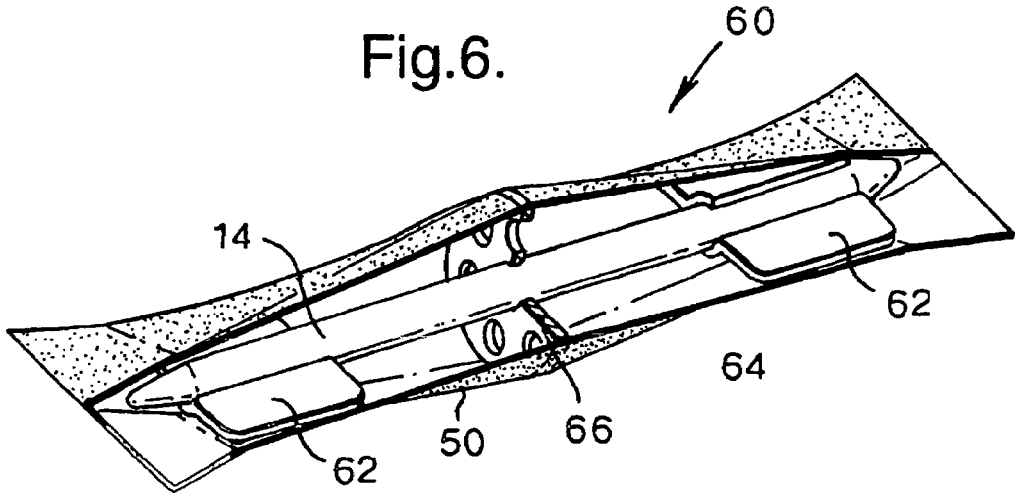
FIG. 6 is a similar to FIG. 5, fins being provided for soft ground contact.

FIG. 6 shows a NLLM 60 suitable for use in sand and in very soft ground. The mine 60 is further provided with fin elements 62 which are arranged for horizontal deployment to support the extremities of the sealed glass tube fragile container 64. Thus shoe pressure on the container 64 or on the washer-like element 66 is resisted by the fin elements 62, causing the application of a bending force and breakage of the container 64 and immediate activation of the NLLM 60.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A non-lethal anti-personnel land mine comprising a first inner sealed fragile container having a first chemical reactant contained therein, and a second outer container having a second chemical reactant contained therein, said first inner sealed fragile container being provided with support means in contact therewith and positioned to assure that a stepping action on said mine will result in the breaking of said fragile container and the release of the contents thereof into contact with said second chemical reactant in said outer container, whereby said contact results in a fast chemical reaction non-lethal and non limb-wounding to the person stepping on said mine, said land mine further including fin elements which are arranged for horizontal deployment to support the extremities of said sealed fragile container, wherein said first container is a thin hermetically-sealed glass vial and said support means is a washer-like element having a central opening for receiving a segment of said vial, said washer-like element having a diameter substantially greater than that of said glass vial for elevating said glass vial above a ground support surface as well as being positioned to transfer body weight forces directly to said vial large enough to break the same.

2. A non-lethal anti-personnel land mine according to claim 1, wherein said chemical reaction is an exothermic reaction.

3. A non-lethal anti-personnel land mine according to claim 1, wherein said chemical reaction is a pyrotechnical reaction.

4. A non-lethal anti-personnel land mine according to claim 1, wherein said chemical reaction results in the release of an irritant material.

5. A non-lethal anti-personnel land mine according to claim 1, wherein said chemical reaction results in the release and dispersion of a color dye material.

6. A non-lethal anti-personnel land mine according to claim 1, wherein said first chemical reactant is in liquid form.

7. A non-lethal anti-personnel land mine according to claim 1, wherein at least one of the chemical reactants is a liquid.

* * * * *

UNITED STATES PATENT AND TRADEMARK OFFICE

CERTIFICATE OF CORRECTION

PATENT NO. : 7,458,321 B2
APPLICATION NO. : 10/570968
DATED : December 2, 2008
INVENTOR(S) : Aharon Bornstein et al.

It is certified that error appears in the above-identified patent and that said Letters Patent is hereby corrected as shown below:

Title Page, Item (73) Assignee: should read,
--(73) Assignee: Israel Atomic Energy Commission, Yavne (IL); and Eshed Chemicals Ltd., Ashdod (IL)--.

Signed and Sealed this

Twenty-fourth Day of March, 2009

JOHN DOLL
*Acting Director of the United States Patent and Trademark Office*